US007770838B2

(12) United States Patent
Plociennik et al.

(10) Patent No.: US 7,770,838 B2
(45) Date of Patent: Aug. 10, 2010

(54) METHOD OF AND DEVICE FOR REDUCING THE STATIC FRICTION BETWEEN A REEL AND A COIL

(75) Inventors: Uwe Plociennik, Ratingen (DE); Klaus Küeppers, Erkrath (DE); Meinert Meyer, Erkrath (DE); Georg Rebel, Düesseldorf (DE)

(73) Assignee: SMS Siemag Aktiengesellschaft, Duesseldorf (DE)

( * ) Notice: Subject to any disclaimer, the term of this patent is extended or adjusted under 35 U.S.C. 154(b) by 54 days.

(21) Appl. No.: 11/632,394

(22) PCT Filed: Jun. 21, 2005

(86) PCT No.: PCT/EP2005/006674

§ 371 (c)(1),
(2), (4) Date: Jun. 10, 2008

(87) PCT Pub. No.: WO2006/007920

PCT Pub. Date: Jan. 26, 2006

(65) Prior Publication Data

US 2008/0258000 A1 Oct. 23, 2008

(30) Foreign Application Priority Data

Jul. 15, 2004 (DE) ..... 10 2004 034 091

(51) Int. Cl.
*B65H 75/24* (2006.01)

(52) U.S. Cl. ..... 242/571; 242/571.7; 242/572; 242/573.1; 242/573.2; 242/576.1

(58) Field of Classification Search ..... 242/571, 242/571.7, 572, 573, 573.1–573.2, 576, 576.1
See application file for complete search history.

(56) References Cited

U.S. PATENT DOCUMENTS

| | | | | |
|---|---|---|---|---|
| 4,429,838 | A * | 2/1984 | Lenk et al. | 242/573.7 |
| 4,433,814 | A | 2/1984 | Pontes et al. | |
| 4,469,288 | A | 9/1984 | Pontes et al. | |
| 4,693,431 | A * | 9/1987 | Kataoka | 242/413.1 |
| 4,715,553 | A * | 12/1987 | Hatakeyama et al. | 242/573.7 |
| 4,801,109 | A * | 1/1989 | Hatakeyama et al. | 242/571.3 |
| 4,911,376 | A * | 3/1990 | Thompson | 242/573.2 |
| 6,216,977 | B1 * | 4/2001 | Setzer et al. | 242/573.7 |
| 6,405,970 | B1 * | 6/2002 | Ueyama | 242/573.2 |

FOREIGN PATENT DOCUMENTS

| | | |
|---|---|---|
| GB | 1357066 | 6/1974 |
| GB | 1375589 | 11/1974 |

OTHER PUBLICATIONS

Search Report.

* cited by examiner

*Primary Examiner*—Sang Kim
(74) *Attorney, Agent, or Firm*—Abelman, Frayne & Schwab

(57) ABSTRACT

The invention relates to a method of releasing a reel awe, which is hydraulically restrained by a self-locking effect by means of inwardly located wedge surfaces of expansion elements. Removal of a coil from a reel awe is achieved, without problems, by lifting off the self-locking effect of the expansion elements at least partially or completely by applying longitudinal vibrations acting in an axial direction. The invention also relates to a correspondingly formed device.

4 Claims, 3 Drawing Sheets

METHOD OF AND DEVICE FOR REDUCING THE STATIC FRICTION BETWEEN A REEL AND A COIL

Figure 1:
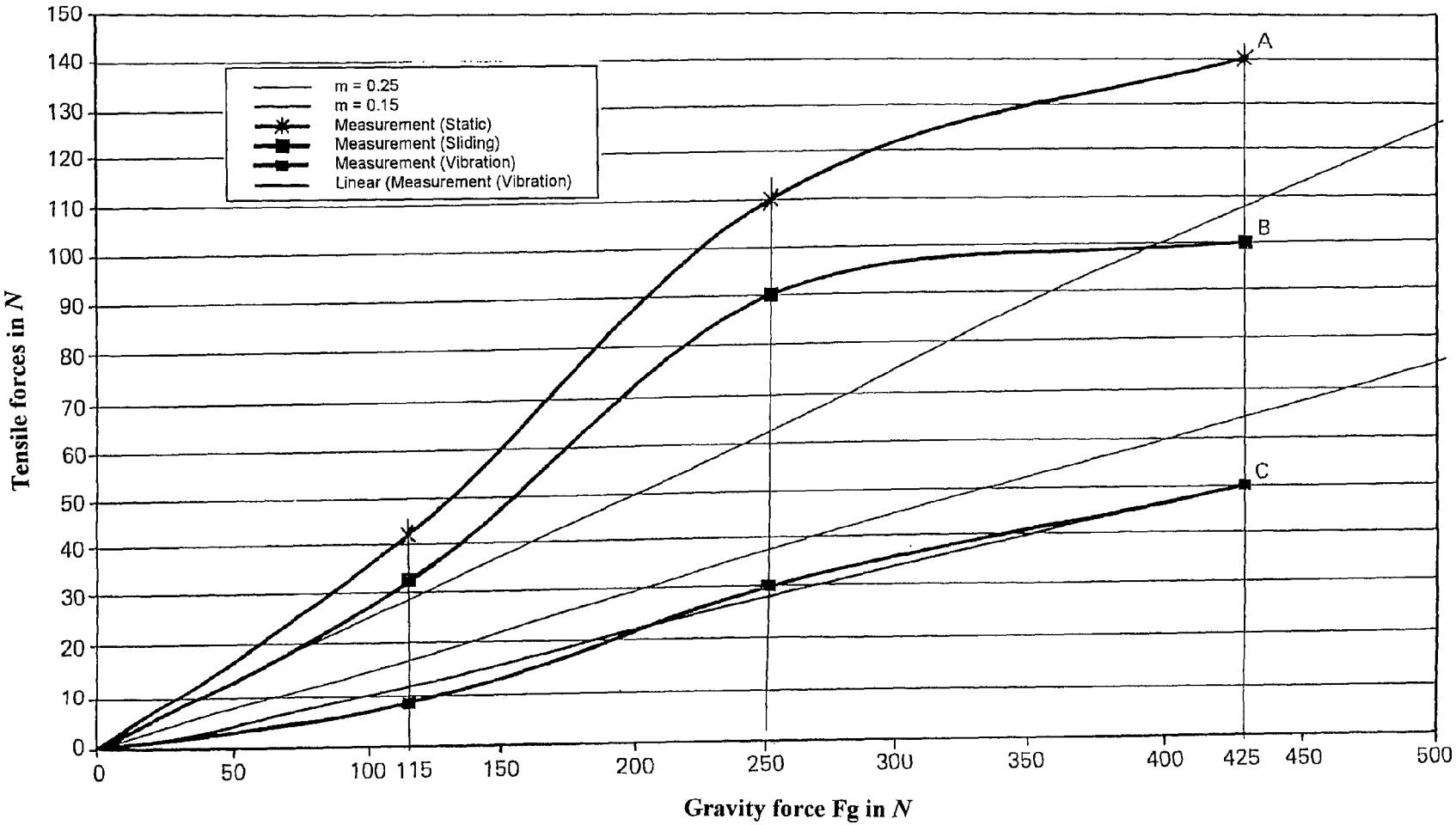

In numerous fields of installation manufacturing, an undesired static friction leads to negative effects which can often be compensated only with large technical expenses.

E.g., during winding up of a cold strip, the reel mandrel is hydraulically restrained with inwardly located wedge surfaces. After the winding-up, the locking segments should be returned in their initial position by the circumferential pressure of the wound-up strip to thereby release the reel awe. However, though the inclination of the wedge surfaces lies in the vicinity of the static friction angle, it often occurs that because of an insufficient lubrication, the segments do not collapse and the coil is not released.

The state of the art shows examples of releasing the self-locking effect of expansion elements by inducing vibrations.

A document DE 21 63 971 A1 from another field discloses a method of reducing friction between a thread and thread guiding parts of textile machines. To this end, a thread is tangentially wound on a drum and is drawn off axially from the drum by a brake ring which is formed by a base ring that surrounds the drum at a distance therefrom, and elastic separate fingers distributed over the circumference of the base ring at a distance from each other and extending therefrom toward a surface of a storage drum, with the fingers extending inwardly from the base ring along a virtual conical surface and inclined in the circumferential direction in the direction of the relative circulation of the thread about the drum, with the thread overlapping the fingers, the free ends of which are supported against a drum shoulder, so that the thread, upon sliding over the fingers, generates vibrations.

Document JP 60244764 discloses a device for placing and retaining empty bobbins between a support and a handle. The support handle is pressed back by a drive in order to bring the empty bobbins in contact with a functional roller. A vibration produced thereby is detected by a vibration detector that is arranged on the support arm. The vibration detector is connected with a vibration mode comparator for comparing amplitude at a time A and B with a predetermined reference amplitude. In this way, it can be determined whether the empty bobbin is fixedly mounted on the support arm or not.

Document DE 22 23 195 A1 describes a method of and an apparatus for a non-thermal release of mechanical connections. To this end, one of the connected parts is subjected to mechanical vibrations in the frequency range of the ultrasound for releasing the connection. There is provided a clamping device for clamping at least one of the plates of the to-be-loosened element. The clamping device is fixedly mounted on a cone-shaped mandrel the other end of which is fixedly connected for transmission of vibrations, with a mechanical transmitter that is amplitude-controlled and operates in the frequency range of the ultrasound.

Proceeding from the above-discussed state of the art, the object of the invention is to provide a method and a device suitable to release, during winding of a cold strip, the reel mandrel, which is hydraulically restrained by inwardly located wedge surfaces to such an extent that the locking segments would slide back in the initial position, so that the self-locking effect is released or lifted off, which enables removal of a coil from the mandrel practically without any problem with the use of non-complicated and low-cost means.

To achieve this object, the method according to the present invention contemplates that the self-locking effect of the expansion elements is lifted off at least partially or completely by application of longitudinal vibrations acting in the axial direction.

In the device according to the invention, a vibrator is provided at the end side of the reel mandrel. Suitably, compressed air is fed to the vibrator through a rotary feeding conduit or a quick-acting coupling for its excitation. As vibrators, pneumatic turbo-vibrators or pneumatic impact vibrators can be used.

These vibrations convert static friction between the wedge surfaces of the expansion elements into a sliding friction with a noticeably reduced friction coefficient, so that the reel mandrel is released form the circumferential pressure of the wound-up coil, and the expansion elements collapse independent on their lubrication condition, and the coil is released.

Below, the inventive method will be described with reference to an embodiment of a device suitable for carrying out the method.

Figure 2:
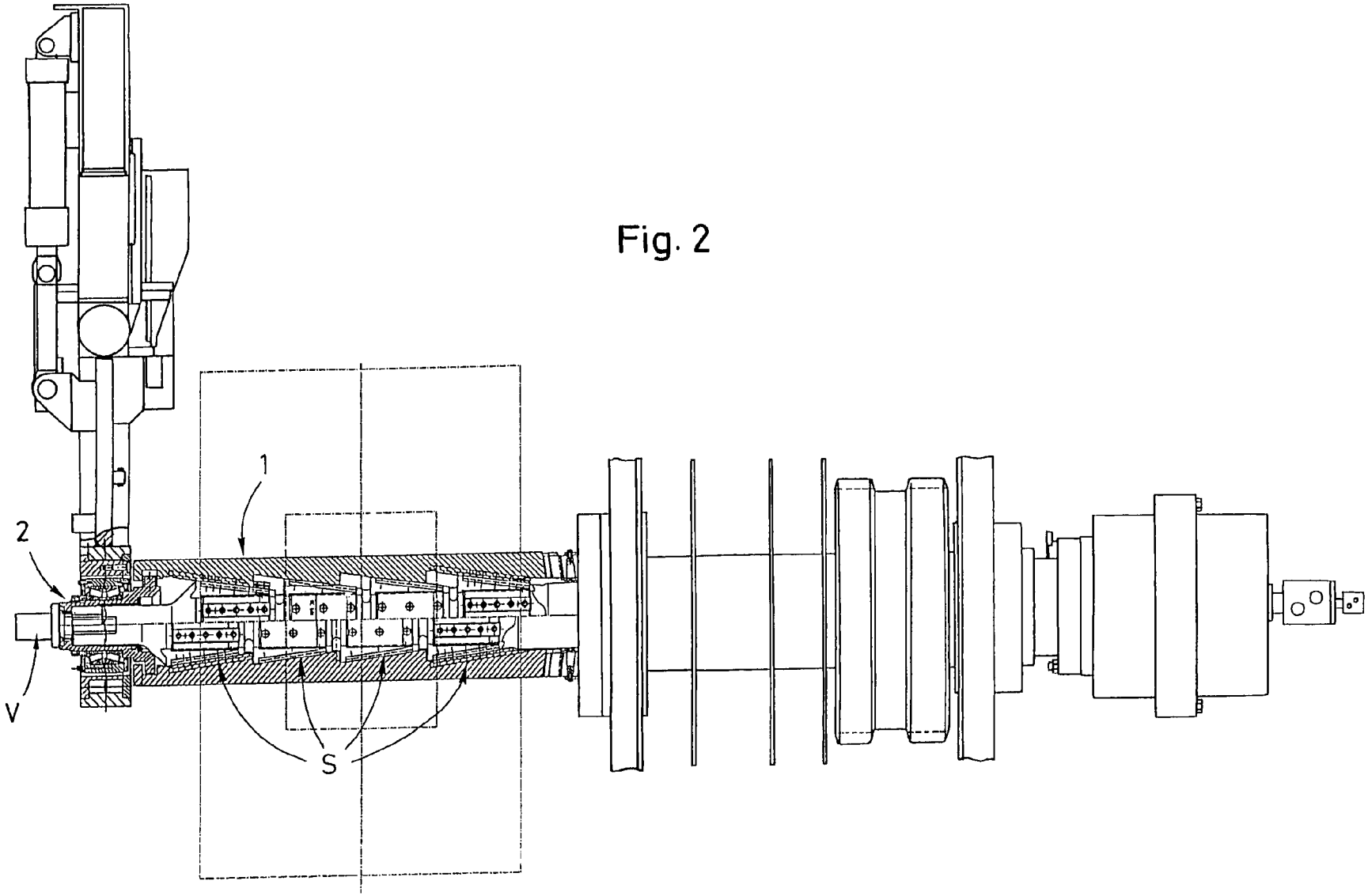
Figure 3:
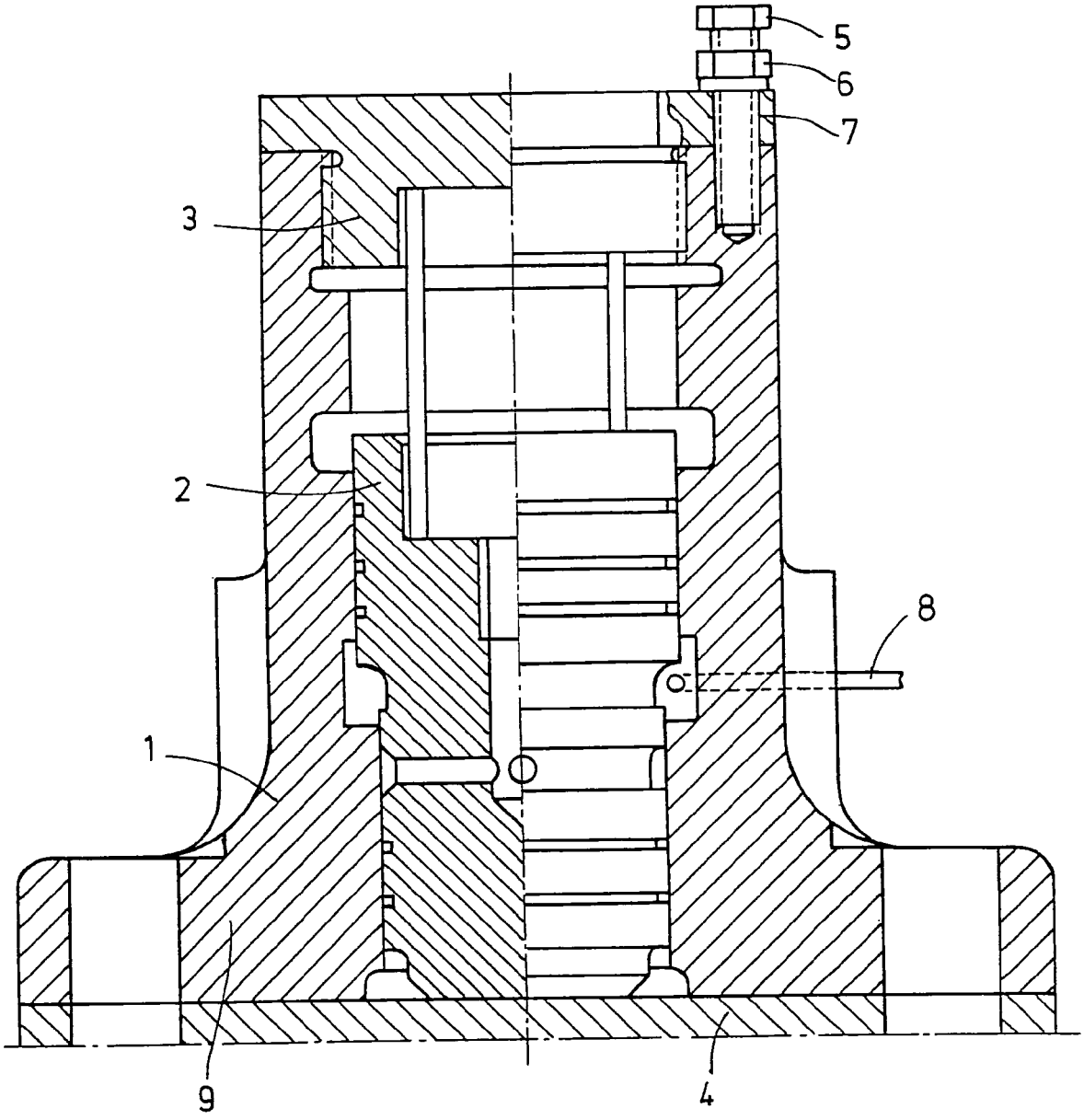

The drawings show:

FIG. 1 in a diagram of a course of friction forces with or without vibration, the course of gravity forces in dependence on tensile forces, and a course of vibration forces in relationship to the accompanying static and/or sliding forces;

FIG. 2 a side, partially cross-sectional view of a reel mandrel, in the center plane, with a vibrator mounted at the end; and FIG. 3 a cross-sectional view of a rotary feeding conduit for compressed air for driving of vibrator V for generating vibration in a longitudinal direction.

According to FIG. 1, there are produced a tensile force of 140 N according to curve A as a result of static friction and a tensile force of 100 N according to curve B with a sliding friction. Corresponding tensile forces C are reduced from 140 N and/or 100 N to a maximum 50 N with vibrations. In all cases, a gravity force Fg of 425 N is preset.

According to FIG. 1, the curve A (static friction) has, for the ratio of the gravity force to the produced thereby, tensile force, an almost linear course between about 115 N and 250 N, with an increase of the tensile force by about 70 N. At a further increase of the gravity force from 250 N to 425 N, the tensile force is increased by simply 30 N.

The curve B (sliding friction) ascents, in the range of the gravity force between 115 N and 250 N, by about 60 N, whereas in the following range of the gravity forces between 250 and 425 N, the tensile forces are simply increased by a small amount of 10 N. However, it is here that the friction coefficient clearly exceeds $\mu=0.2$.

The corresponding values of the curve C (vibration) show, in contrast, an almost linear curve course, with a nearly constant friction coefficient $\mu=0.12$.

FIG. 2 shows a reel mandrel 1 in a half-open condition. There, on each side, a row of, in this case, of four wedge surfaces S, is shown, which produce a self-locking effect during an axial displacement of the mandrel. At the end side 2 of the reel mandrel 1, there is provided a vibrator V. With this arrangement, the vibrations, which are produced thereby and act in the longitudinal direction, are applied to the reel mandrel 1 in the axial direction along the axis X-X through the awe 1 and cause, upon hitting the wedge surfaces S, lifting-off of the locking forces acting on the reel mandrel. With such a release, it is achieved that in the initial position, the expansion elements slide back and, thereby, release or lift off the self-locking effect, enabling removal of coil from the mandrel 1, practically without any problem, with the use of comparatively non-complicated and low-cost means.

As a vibrator, advantageously, a pneumatic impact vibrator is used. Its vibration reduces friction between the wedge surfaces S of the expansion elements to such an extent that the reel mandrel 1 is freed from the circumferential pressure of the wound strip, and the expansion elements collapse and release the coil, without any regard to their lubrication condition.

The vibrator V, which is shown in FIG. 3, has a housing 1' with an end flange 9 with which it is fixedly mounted on the reel shaft 4 of the reel mandrel 1 with the use of a threaded connection.

In the present case, a pneumatic impact vibrator for generating longitudinal impact pulses is used. Its function resembles that of a so-called compression air hammer (percussion hammer-translator's remark) in which a working tool, such as a hammer, which is loosely displaced in a housing, reciprocates under action of air.

The vibrator includes a flying piston 2 with cross-over edges for reciprocal action.

The inner chamber of the vibrator 1 is closed with a cover 3. On the cover, there is arranged a ventilator unit 5, 6, 7 that can be open or closed for a preliminary setting of the percussion action of the impact body 2.

The compressed air flows from a feeding channel 8 through the body of the vibrator 1 and escapes, after exciting the impact body 2, as shown in the drawing, in the atmosphere upon opening of a valve 6.

The inventive method and the corresponding device ideally solve the set-forth object.

The invention claimed is:

1. A method of reducing static friction between a reel mandrel and a strip wound thereon during unwinding of the strip, the reel mandrel being restrained by self-locking effect produced by inwardly located wedge surfaces of a plurality of axially displaceable expansion elements arranged in a row inside the mandrel, the method comprising the step of providing a vibrator at an end of the reel mandrel and including an axially reciprocating body; and passing fluid through the vibrator for exciting the reciprocating body to apply longitudinal vibrations to the reel mandrel in an axial direction of the reel mandrel.

2. The method according to claim 1, wherein the vibration applying step includes applying vibrations having different frequencies.

3. A reel assembly, comprising a reel mandrel for winding up a strip; a plurality of expansion elements located in a row inside the mandrel and having wedge surfaces for restraining the mandrel as a result of a self-locking effect between the wedge surfaces of the expansion elements; and a vibrator provided at an end of the reel mandrel and having means providing for flow of fluid through the vibrator, and a body axially reciprocating in response to flow of the fluid through the vibrator for applying longitudinal vibrations to the mandrel in the axial direction of the mandrel.

4. The reel assembly according to claim 3, wherein the vibrator is formed as a pneumatic turbovibrator or a pneumatic impact vibrator.

* * * * *